US008614648B2

(12) United States Patent
Kojima

(10) Patent No.: US 8,614,648 B2
(45) Date of Patent: Dec. 24, 2013

(54) ANTENNA MODULE, MAGNETIC MATERIAL SHEET AND DOUBLE-SIDED ADHESIVE SPACER, AND METHODS FOR THE MANUFACTURE THEREOF

(71) Applicant: Maruwa, Co., Ltd, Owariasahi (JP)

(72) Inventor: Yasushi Kojima, Joetsu (JP)

(73) Assignee: Maruwa Co., Ltd. (JP)

( * ) Notice: Subject to any disclaimer, the term of this patent is extended or adjusted under 35 U.S.C. 154(b) by 0 days.

(21) Appl. No.: 13/774,070

(22) Filed: Feb. 22, 2013

(65) Prior Publication Data

US 2013/0222198 A1 Aug. 29, 2013

(30) Foreign Application Priority Data

Feb. 28, 2012 (JP) ..... 2012-040954

(51) Int. Cl.
*H01Q 13/10* (2006.01)
*G08B 13/14* (2006.01)
*H01Q 1/08* (2006.01)

(52) U.S. Cl.
USPC ..... 343/785; 343/787; 343/788; 340/572.5; 340/572.6

(58) Field of Classification Search
None
See application file for complete search history.

(56) References Cited

U.S. PATENT DOCUMENTS

| | | | | |
|---|---|---|---|---|
| 6,373,387 | B1 * | 4/2002 | Qiu et al. | 340/572.1 |
| 6,693,541 | B2 * | 2/2004 | Egbert | 340/572.7 |
| 6,693,953 | B2 * | 2/2004 | Cox et al. | 375/141 |
| 6,772,546 | B2 * | 8/2004 | Latschbacher et al. | 40/299.01 |
| 7,495,625 | B2 * | 2/2009 | Endo et al. | 343/788 |
| 2009/0195391 | A1 * | 8/2009 | Honda et al. | 340/572.8 |
| 2010/0148928 | A1 * | 6/2010 | Yeager et al. | 340/10.1 |

FOREIGN PATENT DOCUMENTS

| | | | |
|---|---|---|---|
| JP | 1998-041729 | A | 2/1998 |
| JP | 2006-174223 | A | 6/2006 |
| JP | 2006-295981 | A | 10/2006 |
| JP | 2007-214754 | A | 8/2007 |
| JP | 2009-182062 | A | 8/2009 |

OTHER PUBLICATIONS

Notice of Reasons of Refusal dated Mar. 5, 2013 for Japanese Patent Application No. 2012-286926 (English and Japanese) ; and Decision of Patent Grant dated May 14, 2013 for Japanese Patent Application No. 2012-286926 (English and Japanese).

* cited by examiner

*Primary Examiner* — Trinh Dinh
(74) *Attorney, Agent, or Firm* — Shumaker, Loop & Kendrick, LLP

(57) ABSTRACT

An antenna module and methods for manufacturing an antenna module, the antenna module including a magnetic material sheet for focusing a magnetic flux, an antenna conductor deposited on the magnetic material sheet and formed in a predetermined pattern, and a protection layer deposited on the antenna conductor for protecting the antenna conductor.

22 Claims, 15 Drawing Sheets

ANTENNA MODULE, MAGNETIC MATERIAL SHEET AND DOUBLE-SIDED ADHESIVE SPACER, AND METHODS FOR THE MANUFACTURE THEREOF

CROSS-REFERENCE TO RELATED APPLICATIONS

This application claims priority of Japanese Patent Application Serial No. JP2012-040954 filed Feb. 28, 2012 and Japanese Patent Application Serial No. JP2012-286926 filed Dec. 28, 2012, which are incorporated herein by reference.

TECHNICAL FIELD AND BACKGROUND OF THE INVENTION

The present invention relates to a non-contact type antenna module for transmitting and receiving information by electromagnetic waves and a double-sided adhesive spacer used therefor, and a method of manufacturing an antenna module.

In recent years, there have been distributed non-contact type information communication means that are used for an RFID (Radio Frequency Identification) system such as Osaifu-Keitai (Mobile Wallet) and an IC card. For a module that is used in such a non-contact type information communication means, electronic parts including an insulating base material, a magnetic material, an antenna coil, and an IC chip are essential. The RFID performs information communication with a reader and a writer by using a magnetic field. Therefore, when a conductive body such as a metal is present around the RFID, the reader or writer, an eddy current occurs at the time of passing of the magnetic field through a metal surface, which generates a counter magnetic field in the direction opposite to a magnetic field for communication, resulting in difficulty in communication. Accordingly, a magnetic material is arranged between the metal surface and an IC tag and the like to prevent the magnetic field from passing through the metal surface.

The magnetic material used in the RFID system is required to have high magnetic permeability to obtain the effect described above. A communication characteristic can be improved as a magnetic material thickness becomes larger. On the other hand, because electronic parts such as an insulating base material, a magnetic material, and an antenna coil, which are necessary for the RFID system, need to be superposed in a layer shape, thinning a total thickness of the module is also required. Further, because the module like this may also be arranged on a curved surface, not only on a flat surface, these electronic parts are also required to have flexibility.

An antenna module that satisfies the requirements described above is found in Japanese Laid-open Patent Publication No. 2006-174223, for example, which discloses an antenna module of with a spiral planar antenna set on an aggregate that has a large number of ferrite chips as a magnetic material overlaid on one sheet base material.

A technique of this structure exhibits considerable effects in that: (1) ferrite, which is easily broken when receiving a shock, is formed as a piece of ferrite sheet (a planar aggregate) made of a large number of chips of the smallest shape capable of bearing the shock, and that; (2) an antenna characteristic is improved by making the planar antenna directly contact the planar aggregate, that is, by employing a structure directly placing the spiral planar antenna on the aggregate.

However, an attempt to actually embody this technique faces the following problems. First, in the process of manufacturing chips, chips are formed from a green sheet of ferrite and then sintered, or chips are cutout from the sintered ferrite. Therefore, irregular sizes and shapes of chips in three-dimensions cannot be achieved. Consequently, when the chips of irregular sizes and shapes are laid out on one sheet base material, upper surface heights of the chips do not become flush with each other (a flat surface without unevenness). Therefore, according to JP 2006-174223, a flat surface is formed by superposing another sheet member on the sintered magnetic material, on which the planar antenna is arranged. That is, a total thickness is increased by a thickness of the added sheet member, which is disadvantageous in view of downsizing the antenna module. Further, in a spiral planar antenna made of one conductive wire, a magnetic flux leaks out from a gap between the spiral planar antenna and the aggregate, and as a result, loss of the antenna characteristic occurs.

Second, in the case of arranging the spiral planar antenna on the aggregate, a gap is provided between adjacent chips of the sintered magnetic material, through which the sheet base material and the planar antenna need to be adhered together by an adhesive medium. That is, according to JP 2006-174223, prior to arranging the planar antenna on the sintered magnetic material, the chips of the sintered magnetic material are laid out on the sheet base material with a gap between and then fixed by adhesion. In order to form a flat surface on which the planar antenna is arranged, a process of superposing another sheet member (an adhesive medium) on the chips is required. As a result, not only is there the problem of inevitable loss of the antenna characteristic due to the gap, there is also a problem that a total thickness of the antenna module increases. Further, the manufacturing process becomes complex.

BRIEF SUMMARY OF THE INVENTION

Accordingly, an object of the present invention is to provide a practical and efficient structure and method of assembly for an antenna module capable of exhibiting maximum antenna characteristics.

Another object of the present invention is to provide a thinner antenna module in a non-contact communication system compared to a conventional antenna module without reducing a communication characteristic.

A further object of the present invention is to provide an antenna module that allows an antenna to be set substantially directly on a sintered magnetic material (or magnetic body), and a manufacturing method for the antenna module.

Further, the present invention provides a magnetic material sheet and a manufacturing method thereof, and a double-sided adhesive spacer.

To achieve the foregoing and other objects and advantages, a structure is provided herein including two components (i.e., a protection layer and a double-sided adhesive spacer) separated from a sheet base material on an upper surface and a side surface of a conductor that constitutes a planar antenna.

The embodiments and manufacturing methods described herein make it possible to practically and efficiently manufacture a thin-type antenna module having a satisfactory communication characteristic with high precision.

An antenna module (or an antenna device) according to an embodiment of the present invention includes a magnetic material sheet for focusing a magnetic flux, an antenna conductor that is deposited on the magnetic material sheet and formed in a predetermined pattern, and a protection layer deposited on the antenna conductor for protecting the antenna conductor. The protection layer is directly or indirectly coupled to the magnetic material sheet to sandwich the antenna conductor layer. That is, the antenna conductor and the magnetic material sheet are substantially made to contact to each other to improve the antenna characteristic and thin the antenna module as a whole, by arranging the protection layer to substantially press the antenna conductor to the magnetic material sheet or sandwich the antenna conductor between the magnetic material sheet and the protection layer.

The antenna module according to the embodiment of the present invention may further include a double-sided adhesive spacer arranged between the magnetic material sheet and the protection layer for making the magnetic material sheet and the protection layer adhere to each other. The shape of the double-sided adhesive spacer may include a part or a whole part of a planar shape complementary with a projection surface of the antenna conductor. More specifically, in the relationship between the antenna conductor and the double-sided adhesive spacer in a planar view, a fillet part of the double-sided adhesive spacer is arranged in at least a part of the space where the antenna conductor (the conducting wire and the power feeding pad) is not present. That is, the antenna conductor is inserted in between fillet parts (that is, within a notch) of the double-sided adhesive spacer, or a fillet part of the double-sided adhesive spacer is inserted in an inward region of the antenna conductor (where a conducting wire is not present). Therefore, by using the double-sided adhesive spacer, instead of an adhesion layer of a predetermined thickness between the antenna conducting wire and the magnetic material, the antenna module can be easily assembled without the inconvenience of positional deviation.

The antenna module according to the embodiment of the present invention may further include a protection film arranged between the antenna conductor and the double-sided adhesive spacer for covering the antenna conductor. By sealing the antenna conductor with the protection layer and the protection film, degradation of the antenna conductor due to oxidation, time and the like can be reduced.

In the antenna module according to the embodiment of the present invention, the magnetic material sheet may include a lower protection layer and a sintered magnetic material layer that is adhered to an upper surface of the lower protection layer. The sintered magnetic material layer may be an aggregate of a plurality of sintered magnetic material chips that are arranged substantially without a gap, and the aggregate of the sintered magnetic material chips forms a flat, even surface. More specifically, by setting a surface and a back surface of the sintered magnetic material layer flush, the occurrence of a gap between the antenna conducting wire and the sintered magnetic material chips is suppressed, and the antenna characteristic is improved.

In the antenna module according to the embodiment of the present invention, a gap of 10 μm to 800 μm may be provided between the antenna conductor and the double-sided adhesive spacer. In this arrangement, superposing the antenna conducting wire and the double-sided adhesive spacer can be avoided.

In the antenna module according to the embodiment of the present invention, the antenna module may be a thin-type antenna module, wherein a total thickness of the magnetic material sheet, the antenna conductor and the protection layer is between 30 μm and 515 μm.

In the antenna module according to the embodiment of the present invention, the lower protection layer may be made of a synthetic resin film such as polyethylene terephthalate, polyethylene naphthalate, polycarbonate, and polyimide.

In the antenna module according to the embodiment of the present invention, the protection layer may be made of a synthetic resin film such as polyimide, polyethylene terephthalate, polyethylene naphthalate, polybutylene terephthalate, polyamide imide, polyether ether ketone, polyether sulfone, polyetherimide, polyacetal, and polyphenylene oxide.

In the antenna module according to the embodiment of the present invention, the metal shield may be made from copper, brass, silver, aluminum, nickel, iron and stainless steel.

In the antenna module according to the embodiment of the present invention, the antenna conducting wire may be a metal such as copper, silver and aluminum.

In the antenna module according to the embodiment of the present invention, the sintered magnetic material chips may be a soft magnetic material such as selected from the Mn—Zn series, Ni—Zn series, Mn—Ni series, Mg—Zn series, Ni—Zn—Cu series, Ba series, and Li series.

In the antenna module according to the embodiment of the present invention, the double-sided adhesive spacer may be a synthetic resin such as from the acrylic series, silicon series, epoxy series, fluorine series, and urethane series synthetic resins.

According to another embodiment of the present invention, a method of manufacturing an antenna module includes the steps of providing a magnetic material sheet for focusing a magnetic flux, depositing an antenna conductor on the magnetic material sheet, and depositing a protection layer for protecting the antenna conductor on the magnetic material sheet via the antenna conductor. The protection layer is directly or indirectly coupled to the magnetic material sheet to sandwich the antenna conductor layer. That is, the protection layer substantially presses the antenna conductor onto the magnetic material sheet, or the magnetic material sheet and the protection layer sandwich the antenna conductor. In this configuration, by substantially making the antenna conductor and the magnetic material sheet contact each other, the antenna characteristic can be improved and the antenna module can be thinned as a whole.

The method of manufacturing an antenna module according to the embodiment of the present invention further includes the step of arranging a double-sided adhesive spacer between the magnetic material sheet and the protection layer, and making the magnetic material sheet and the protection layer adhere to each other. The shape of the double-sided adhesive spacer includes apart or a whole part of a planar shape that is complementary with a projection surface of the antenna conductor. That is, by using the double-sided adhesive spacer, instead of providing an adhesion layer of a predetermined thickness between the antenna conducting wire and the magnetic material, the antenna module can be easily assembled without the inconvenience of positional deviation.

In the method of manufacturing an antenna module according to the embodiment of the present invention, the antenna conductor and the protection layer are integrally formed, and the antenna conductor is arranged on the magnetic material sheet together with the protection layer. That is, because the antenna conducting wire and the protection layer are fixed to each other, positional deviation during assembly can be prevented.

In the method of manufacturing an antenna module according to the embodiment of the present invention, the step of providing the magnetic material sheet includes the steps of providing a magnetic material green sheet of a predetermined size, forming a plurality of dividing grooves on the magnetic material green sheet, forming a sintered magnetic material substrate by sintering the magnetic material green sheet on which the plurality of dividing grooves are formed, making a flexible sheet adhere to at least one surface of the sintered magnetic material substrate, and dividing the sintered magnetic material substrate into a plurality of chips by bending the sintered magnetic material substrate to which the flexible sheet is adhered along the plurality of dividing grooves. More specifically, after the magnetic material green sheet having the dividing grooves on the surface thereof is sintered, by bending the planar sintered magnetic material with the flexible sheet on at least one surface of the green sheet, a plurality of scale-like sintered magnetic material chips are easily obtained in a closely adjacent arrangement without cutting out the chips from the planar sintered magnetic material.

The magnetic material sheet according to the embodiment of the present invention is a magnetic material sheet used in the antenna module and for focusing a magnetic flux, and includes a sintered magnetic material layer that has a plurality of dividing grooves formed on at least one surface, and a lower protection layer on one surface of which a first adhesive layer to be adhered to the sintered magnetic material layer is formed. More specifically, by bending the magnetic material sheet along the dividing grooves, the magnetic material sheet can be easily divided into a plurality of chips, and the flexible sheet can be easily formed according to usage. In this case, because the plurality of chips of the sintered magnetic material are held on the adhesive layer of the lower protection layer, forming a gap provided by chips moved at the time of dividing the sintered magnetic material layer or at the time of using the antenna module is prevented, and the antenna characteristic of the antenna module having the magnetic material sheet is improved. Further, after the sintered magnetic material layer is divided, a plurality of chips are arranged substantially without a gap, and an aggregate of the plurality of chips forms a substantially flat, even surface. More specifically, by setting a front surface and a back surface of the sintered magnetic material layer flush, the occurrence of a gap between the antenna conductor and the sintered magnetic material chips is suppressed, and the antenna characteristic is improved.

The double-sided adhesive spacer according to the embodiment of the present invention is a double-sided adhesive spacer for making the magnetic material sheet and the protection layer of the antenna module adhere to both surfaces of the double-sided adhesive spacer, and also for forming an intermediate layer between the magnetic material sheet and the protection layer together with the antenna conductor. The shape of the double-sided adhesive spacer includes apart or a whole part of a planar shape that is complementary with a projection surface of the antenna conductor. More specifically, by using the double-sided adhesive spacer, instead of an adhesion layer of a predetermined thickness between the antenna conducting wire and the magnetic material, the antenna module can be easily assembled without the inconvenience of positional deviation.

The double-sided adhesive spacer according to the embodiment of the present invention may be made of a synthetic resin such as from the groups including acrylic series, silicon series, epoxy series, fluorine series, and urethane series.

According to the present invention, the communication characteristic can be improved and the thickness of the antenna module can be reduced. Therefore, an RFID system such as Osaifu-Keitai and an IC card can be increasingly thinned.

BRIEF DESCRIPTION OF THE DRAWINGS

FIG. 8(*a*) is a perspective view of a magnetic material green sheet;

FIG. 8(*b*) is a perspective view showing a state that dividing grooves are formed;

FIG. 8(*c*) is a perspective view showing that a protection layer before being divided is adhered to sintered magnetic material chips;

FIG. 8(*d*) is a perspective view of the magnetic material sheet;

FIG. 10(*a*) is a cross-sectional view taken along the line C-C of the protection layer having an antenna in FIG. 9;

FIG. 10(*b*) is a cross-sectional view of the protection layer with an antenna, showing that a planar adhesion body is adhered to an upper surface of the protection layer;

FIG. 10(*c*) is a cross-sectional view of the antenna structure;

FIG. 11(*a*) is a cross-sectional view of the protection layer with an antenna taken along the line C-C in FIG. 9;

FIG. 11(*b*) is a cross-sectional view of the protection layer with an antenna, showing that an insulating film is formed on the upper surface of the protection layer;

FIG. 11(*c*) is a cross-sectional view of the protection layer with an antenna, showing that a planar adhesion body is further formed on the insulation film;

FIG. 11(*d*) is a cross-sectional view of the antenna structure;

FIG. 13(*a*) is a cross-sectional view when a protection film is set on the protection layer having an antenna;

FIG. 13(*b*) is a cross-sectional view of the protection layer with an antenna, showing that a planar adhesion body is adhered to an upper surface of the protection layer having an antenna;

FIG. 13(*c*) is a cross-sectional view of the antenna structure;

DETAILED DESCRIPTION OF THE INVENTION

Figure 1:
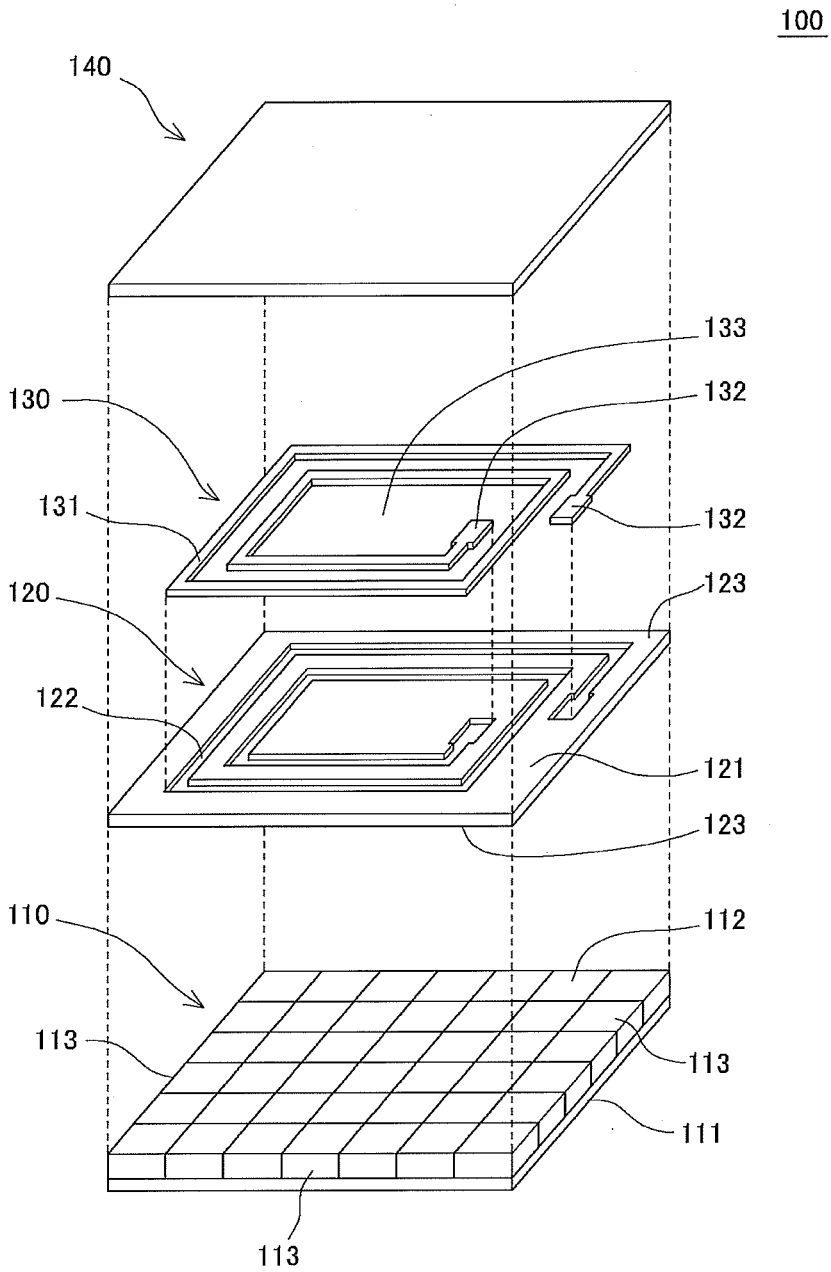
FIG. 1 is an exploded perspective view of an antenna module according to an embodiment of the present invention.

An antenna module (e.g., an antenna device) according to an embodiment of the present invention is described below with reference to the drawings. Shapes in the drawings referred to in the following explanation are conceptual diagrams or schematic views for explaining preferred shapes and dimensions, and a dimension ratio and others do not necessarily coincide with the actual ratio. That is, the present invention is not limited to the dimension ratios shown in the drawings.

Figure 2:
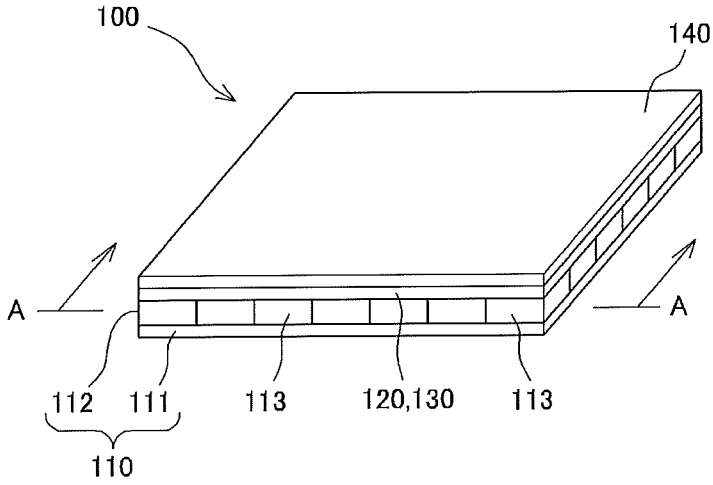
FIG. 2 is a perspective view of the antenna module according to the embodiment of the present invention.
Figure 3:
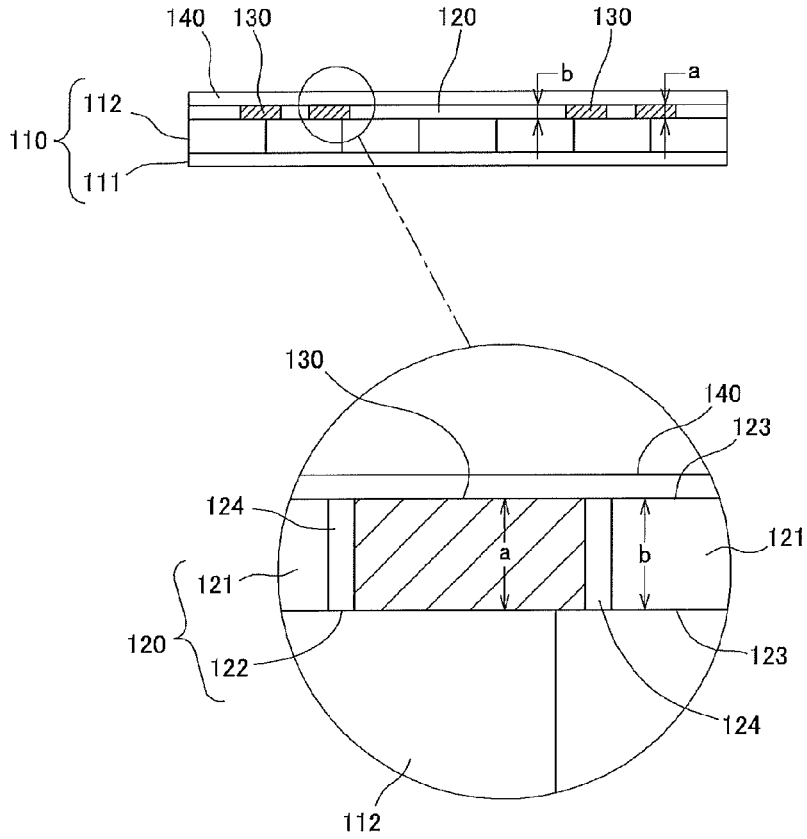
FIG. 3 is a cross-sectional view taken along the line A-A in FIG. 2.

FIG. 1 is an exploded perspective view of an antenna module 100 of the present invention, FIG. 2 is a perspective view of the antenna module 100, and FIG. 3 is a cross-sectional view of the antenna module 100 (with a partially enlarged view thereof). A structure of the antenna module 100 according to an embodiment of the present invention is explained in detail below.

As shown in FIGS. 1 to 3, the antenna module 100 includes a magnetic material sheet 110 in a planar shape for focusing a magnetic flux, an antenna conductor 130 in a planar shape that is deposited on the magnetic material sheet 110 and is formed in a predetermined pattern, and a planar protection layer 140 (generally called an antenna base material) that is deposited on the antenna conductor 130 for protecting the antenna conductor 130.

The magnetic material sheet 110 is formed of a lower protection layer (or a flexible sheet) 111 and a sintered magnetic material layer 112 adhered onto the lower protection layer 111. The sintered magnetic material layer 112 is formed of a plurality of chips 113 arranged vertically and transversely. There are substantially no gaps between the adjacent chips 113. The sintered magnetic material layer 112 (or the magnetic material sheet 110) has flat upper and lower surfaces substantially without unevenness. Each of the chips is formed in a width of preferably about 0.3 mm to 3.0 mm (2.0 mm in the present embodiment), thereby providing a smooth surface shape when the antenna module is deformed. Depending on an embodiment, dividing grooves as described later may be provided on either one surface or both surfaces of the sintered magnetic material layer, instead of dividing the sintered magnetic material layer into the plurality of chips. In this case, a distance between the dividing grooves corresponds to the width of the respective chips. Alternatively, depending on an embodiment, the sintered magnetic material layer may be formed of chips that are arranged in an irregular pattern (formed without the dividing grooves to be described later).

In the antenna module 100, a double-sided adhesive spacer 120 in a planar shape is arranged between the magnetic material sheet 110 and the protection layer 140 such that the magnetic material sheet 110 and the protection layer 140 are adhered to both surfaces of the double-sided adhesive spacer 120. The double-sided adhesive spacer 120 includes a fillet part 121 in a sheet shape, a notch 122 formed through the fillet part 121 in a shape that the antenna conductor 130 having a spiral shape in a planar view can be inserted, and adhering surfaces 123 formed on both surfaces of the fillet part 121. Then, as shown in FIG. 1, a whole of the antenna conductor 130 is arranged within the notch 122.

As shown in FIG. 3, the thickness a of the antenna conductor 130 and the thickness b of the double-sided adhesive spacer 120 are substantially the same. Because the antenna conductor 130 and the double-sided adhesive spacer 120 are flush with each other (have a flat surface without unevenness) on both front and back surfaces, the sintered magnetic material layer 112 can be adhered to one of the surfaces while the protection layer 140 can be adhered to the other surfaces. In this case, because an additional adhesion layer in a predetermined thickness is not present between the antenna conductor 130 and the sintered magnetic material layer 112, a structure is obtained in which the magnetic material sheet 110 and the protection layer 140 sandwich the antenna conductor 130, and the protection layer 140 presses the antenna conductor 130. In this way, the antenna conductor 130 is present between the protection layer 140 and the sintered magnetic material layer 112.

Figure 4:
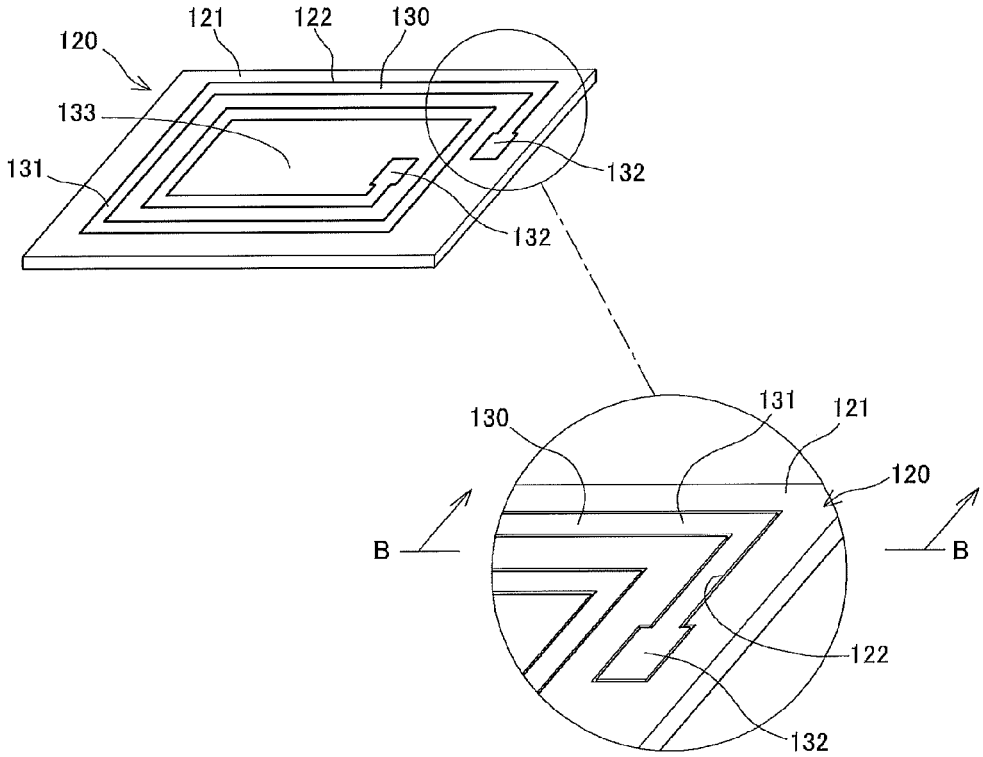
FIG. 4 is a perspective view showing the antenna conductor of FIG. 1 embedded in a double-sided adhesive spacer.

FIG. 4 is a schematic view showing that the antenna conductor 130 is embedded in the notch 122 of the double-sided adhesive spacer 120. The antenna conductor 130 is formed of an antenna conducting wire 131 that extends in a spiral shape in a planar view, and a power feeding pad 132 having a large width provided at both ends of the antenna conducting wire 131. The antenna conductor 130 has an inward region 133 surrounded by a winding in an innermost periphery of the antenna conductor 130. As shown in FIG. 4, because the notch 122 formed in the double-sided adhesive spacer 120 and the antenna conductor 130 have approximately the same shape in a planar view, the antenna conductor 130 is completely buried in the notch 122. That is, because a planar view shape of the fillet part 121 of the double-sided adhesive spacer 120 is in a so-called "complementary relationship" with a projection surface of the antenna conductor 130, the antenna conductor 130 can be embedded in the notch 122. Then, by combining the double-sided adhesive spacer 120 and the antenna conductor 130, an intermediate layer is formed (arranged between the magnetic material sheet 110 and the protection layer 140) of approximately a flat surface with substantially no protrusion on an upper surface and a lower surface.

Figure 5:
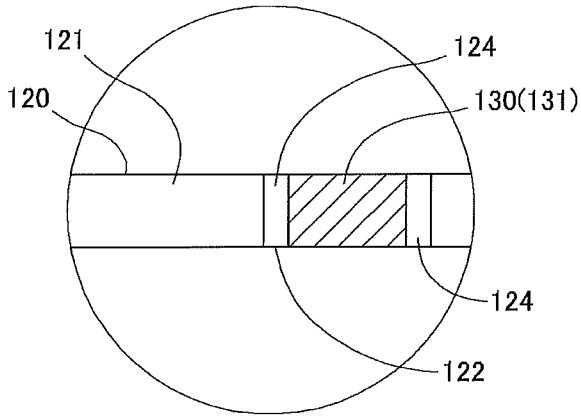
FIG. 5 is a cross-sectional view taken along the line B-B in FIG. 4.

In the present embodiment, the double-sided adhesive spacer 120 (the fillet part 121) has a planar shape, of which substantially a whole part is in a so-called "complementary relationship" with the projection surface of the antenna conductor 130. Although this "a whole part" means that a shape of the notch 122 and a shape of the antenna conductor 130 are approximately the same, a slight gap 124 may be present between the antenna conductor 130 and the double-sided adhesive spacer 120 as shown in FIG. 3 and FIG. 5 (a cross-sectional view taken along the line B-B in FIG. 4). That is, the notch 122 may be larger than the antenna conductor 130, and the antenna conductor 130 can be embedded in such a notch 122. However, conversely, when the notch 122 is set smaller than the antenna conductor 130, the antenna conductor 130 cannot be embedded in the double-sided adhesive spacer 120, and the antenna conductor 130, and thereby the double-sided adhesive spacer 120, are stacked in a thickness direction. Consequently, thinning of the antenna module cannot be achieved.

FIG. 5 shows a cross-sectional view illustrating a state in which the antenna conductor 130 is embedded in the notch 122. The antenna conductor 130 and the double-sided adhesive spacer 120 have mutually substantially the same thickness as described above. Thus, the front surfaces and the back surfaces of the antenna conductor 130 and the double-sided adhesive spacer 120 are respectively substantially flush with each other.

As shown in FIG. 3 and FIG. 5, when the gap 124 of 10 μm to 800 μm is provided in advance in every boundary region between the antenna conductor 130 and the double-sided adhesive spacer 120, it is possible to suppress the inconvenience that the antenna conductor 130 and the double-sided adhesive spacer 120 are superposed with each other due to a positional deviation in the assembly process. However, when the antenna conductor 130 is formed in a spiral shape, a gap between wire parts running in parallel of the antenna conducting wire 131 becomes narrow, possibly causing difficulty in providing the gap 124. In this case, a gap may be provided in advance at any one of an inside and an outside of the antenna conductor 130 having a spiral shape.

Further, as described above, because no additional adhesion layer is present between the sintered magnetic material layer 112 and the antenna conductor 130, the antenna conductor 130 is directly mounted on the sintered magnetic material layer 112 and in contact therewith. Because of absence of a distance between the sintered magnetic material layer 112 and the antenna conductor 130, the communication characteristic is further improved. The double-sided adhesive spacer 120 couples between the protection layer 140, the sintered magnetic material layer 112, and the antenna conductor 130. By employing an adhesion method such as this, it is not necessary to provide an adhesive layer between the magnetic material and the antenna conductor to fix them as in conventional techniques. Therefore, the total thickness of the antenna module is reduced.

Figure 6:
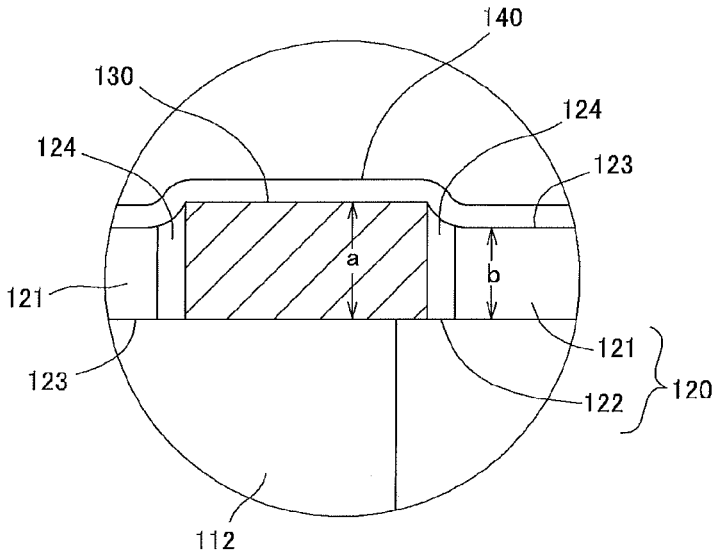
FIG. 6 is a schematic cross-sectional view of the antenna module, where the antenna conducting wire thickness a is greater than the double-sided adhesive spacer thickness b.

The exclusion of any unnecessary thickness elements except for the magnetic material sheet 110 and the antenna conductor 130, which are essential elements to obtain the antenna characteristic, is found in the present invention. Therefore, as shown in FIG. 6, for example, the thickness a of the antenna conductor 130 may be larger than the thickness b of the double-sided adhesive spacer 120. In this way, when the thickness a of the antenna conductor 130 is larger than the thickness b of the double-sided adhesive spacer 120, the protection layer 140 is bent to cover and bury a difference of these thicknesses. Preferably, the thickness a of the antenna conductor 130 and the thickness b of the double-sided adhesive spacer 120 are set in the same thickness, and the resulting thickness of the antenna module becomes entirely flat. On the other hand, when the thickness a of the antenna conductor 130 is set smaller than the thickness b of the double-sided adhesive spacer 120, a total thickness is slightly increased, which is included within a range of the present invention.

As described above, the thin antenna module 100 is manufactured by depositing components of the above-described thicknesses, and has a thickness of 30 μm to 215 μm as a whole. Further, the antenna module 100 according to the present embodiment is formed to have a length of 55 mm and a width of 40 mm. However, the sizes of the antenna module according to the present invention can be arbitrarily designed according to usage.

For the antenna module according to the present invention, known materials can be used.

In the present embodiment, the magnetic material sheet 110 is formed of the lower protection layer 111, and the sintered magnetic material layer 112 that is adhered to the lower protection layer 111 via a (first) adhesive layer. The sintered magnetic material layer 112 may be simply a sintered magnetic material substrate, but it is preferable to employ an aggregate of many scale-like magnetic material chips (divided pieces) to obtain a flexible antenna module.

The first adhesive layer coated on one surface of the lower protection layer 111 is made of an adhesive compound of the acrylic series, silicon series, and the like. For the lower protection layer 111, a planar insulator can be used made of a film of, for example, polyester series, polycarbonate, and polyimide; a metal shield formed by sputtering, electrolytic plating, non-electrolytic plating, transfer, screen printing, and adhesive compound with a metal foil using metals such as copper, brass, silver, aluminum, nickel, iron, and stainless steel; or a laminated body of the planar insulator and the metal shield, for example. Preferably, a thickness of the lower protection layer 111 is about 5 μm to 20 μm, which is the minimum required to hold the aggregate of the sintered magnetic material layer 112.

In the antenna module, the communication characteristic is greatly changed depending on a metal environment of a terminal to be mounted. Therefore, by proving a metal shield layer in advance in the lower protection layer 111 of the magnetic material of the antenna module to stabilize a value Q and a value L at desired values, thereafter, a change of the antenna characteristic after the antenna module is adhered to a metal of a battery pack or a shield case of the terminal can be minimized. For the lower protection layer 111, one that uses a metal shield, one that has an insulator laminated with a metal shield, or one that has a double-sided adhesive material laminated with a metal shield can be used. The metal shield has a minimum necessary thickness to hold the aggregate of the sintered magnetic material layer 112, like the thickness of the insulator, and preferably, the thickness of the metal shield is about 5 μm to 35 μm to stabilize the value Q and the value L at a desired value.

In the case of making the antenna module adhere to a metal part such as a battery pack and a shield case of the circuit substrate, it is preferable to form a second adhesive layer (not shown) on a lower surface (a surface at an opposite side of the first adhesive layer) of the lower protection layer 111. Further, when the antenna module is used mainly for a mobile phone, the antenna module is adhered to the battery pack or to a rear cover in many cases. By forming the second adhesive layer on a bottom surface or a top surface of the antenna module (that is, a lower surface of the magnetic material sheet 110 or an upper surface of the protection layer 140) in advance corresponding to a position to be adhered, the antenna module can be easily adhered to an electronic device such as a mobile phone via the second adhesive layer to be arranged at the using position. The second adhesive layer is made of an adhesive compound of acrylic series and silicon series, for example.

Further, the sintered magnetic material layer 112 is selected from a typical soft magnetic material such as Mn—Zn series, Ni—Zn series, Mn—Ni series, Mg—Zn series, Ni—Zn—Cu series, Ba series, and Li series. However, when a material of high magnetic permeability that can focus a magnetic flux from outside is used, the material of the sintered magnetic material layer is not limited to the above-described materials. A thickness of each one of the chips 112*a* of the sintered magnetic material layer 112 is preferably from 10 μm to 100 μm.

For the double-sided adhesive spacer 120, a resin from an acrylic-series resin, a silicon-series resin, an epoxy-series resin, a fluorine-series resin, and a urethane-series resin can be used, for example. Further, a double-sided adhesive spacer in a three-layer structure that has an adhesion layer on both surfaces of a resin sheet of epoxy, polyethylene terephthalate and the like can be also used. As long as a thickness of the double-sided adhesive spacer 120 does not exceed a thickness of the antenna conductor 130 (preferably, 10 μm to 70 μm), the double-sided adhesive spacer 120 of any thickness can be used, and preferably, the double-sided adhesive spacer 120 has about the same thickness as the antenna conductor 130.

For the antenna conductor 130, copper, aluminum, and silver can be sued, for example. A thickness of the antenna conductor 130 is preferably 10 μm to 70 μm to satisfy the antenna characteristic that is necessary for communication of the RFID system. A cross-sectional shape of the antenna conductor 130 is preferably a rectangle or a trapezoid.

The protection layer 140 is formed preferably by a material that can protect the antenna conductor 130 closely adhered thereto, from an external environment. For example, a heat-resistant base material such as polyimide, polyethylene terephthalate, and polyethylene naphthalate can be used. The thickness of the protection layer 140 is preferably from 3 μm to 25 μm.

Figure 7:
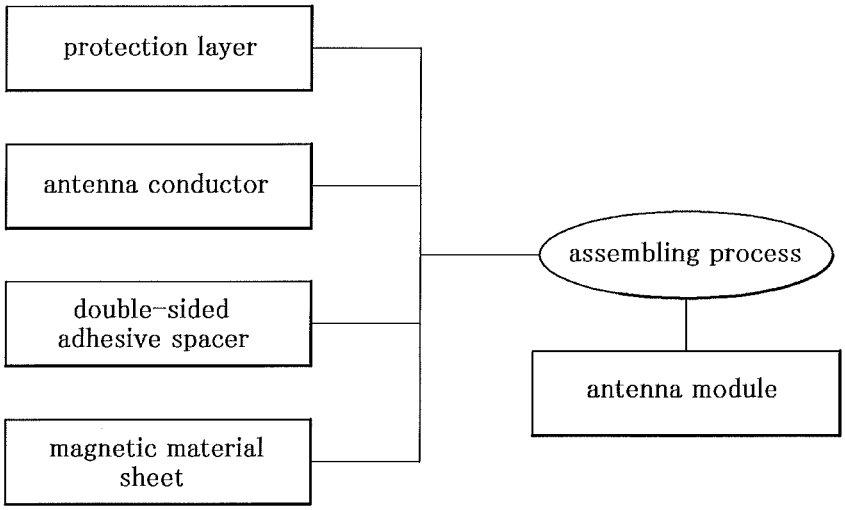
FIG. 7 is a flow diagram illustrating the manufacturing process of the antenna module according to the embodiment of the present invention.

FIG. 7 is a simplified drawing showing a manufacturing method of manufacturing the antenna module according to the present invention. First, the magnetic material sheet 110, the double-sided adhesive spacer 120, the antenna conductor 130, and the protection layer 140 are prepared respectively. Then, by combining and assembling the protection layer 140, the antenna conductor 130, and the magnetic material sheet 110 via the double-sided adhesive spacer 120, the antenna module 100 can be obtained.

Next, each process of the method of manufacturing the antenna module according to the present invention is explained in detail below.

Figure 8:
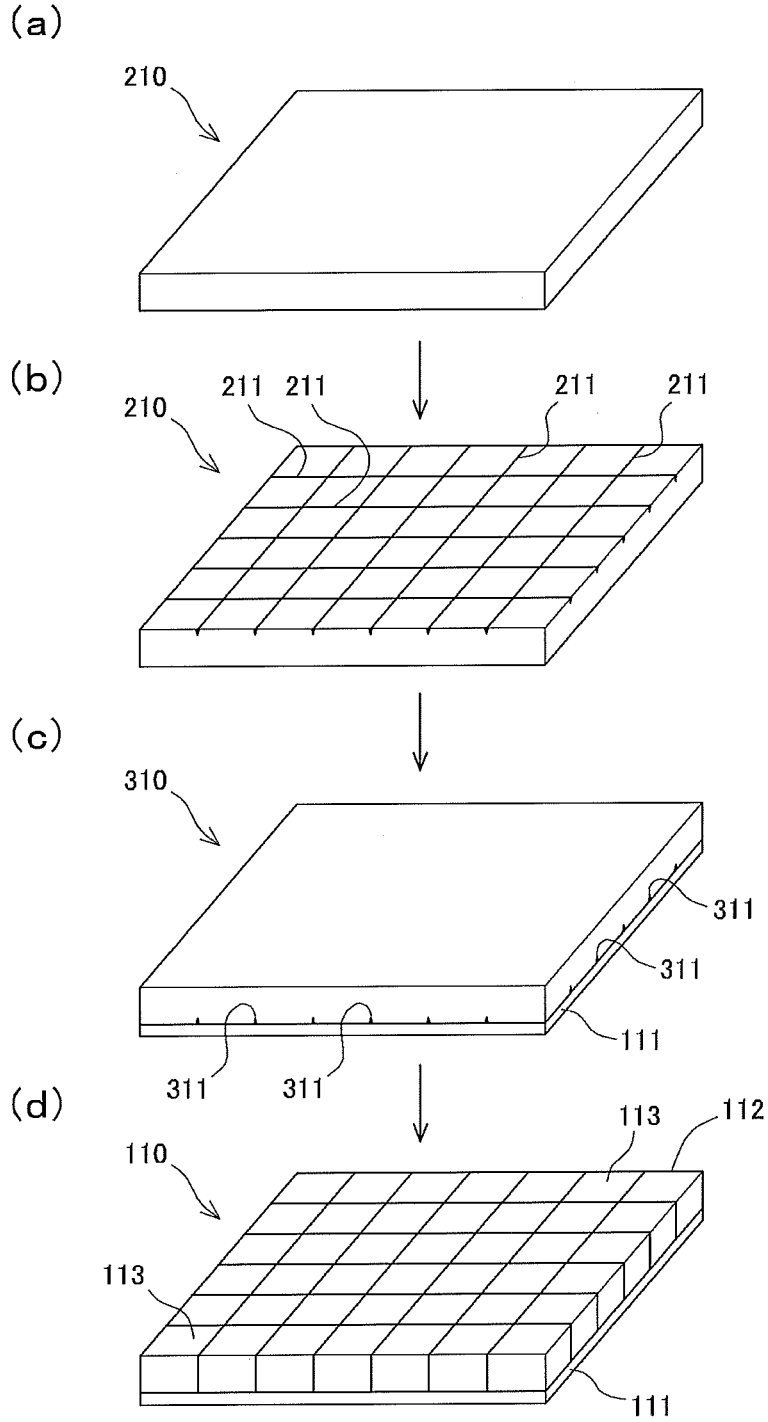
FIGS. 8(*a*) to (*d*) illustrate a process of producing a magnetic material sheet of the antenna module according to the embodiment of the present invention.

First, a method of manufacturing the magnetic material sheet 110 is explained with reference to FIG. 8. The above-described known magnetic material powder is mixed with a binder such as a butyral resin, polybutyl methacrylate and a solvent such as butyl alcohol and toluene to obtain a slurry. Thereafter, a magnetic material green sheet in a predetermined thickness is formed by a doctor blade method. Then, after being cut in a desired size, this magnetic material green sheet 210 is sintered, as shown in FIG. 8(*a*). However, before the sintering, it is preferable to form dividing grooves 211 in advance as shown in FIG. 8(*b*) on the magnetic material green sheet 210. By forming the dividing grooves 211 in both vertical and transverse directions in advance, a subsequent process of dividing the sintered magnetic material substrate into sintered magnetic material chips can be smoothly performed. The dividing grooves 211 can be formed in an arbitrary pattern, such as broken-line grooves, dashed-line grooves, and the like, in addition to continuous grooves shown in FIG. 8(*b*). Then, by sintering the magnetic material green sheet 210, a sintered magnetic material substrate 310 (FIG. 8(*c*)) is obtained.

Thereafter, as shown in FIG. 8(*c*), a flexible sheet (the lower protection layer 111 in the present embodiment) is adhered to one or both of surfaces of the obtained sintered magnetic material substrate 310. The sintered magnetic material substrate 310 includes dividing grooves 311 corresponding to the dividing grooves 211 of the magnetic material green sheet 210. Preferably, the flexible sheet is adhered to at least a surface of the dividing grooves 311. Then, when the sintered magnetic material substrate 310 to which the lower protection layer 111 is adhered is bent, the sintered magnetic material substrate 310 is divided along the dividing grooves 311 that is formed in advance. At this time, because the sintered magnetic material substrate 310 is adhered to the lower protection layer 111, the divided scale-like pieces are not scattered without being cut out from the sintered magnetic material substrate 310. As shown in FIG. 8(*d*), the sintered magnetic material layer 112 as the aggregate of the sintered magnetic material chips 112*a* which are in a closely adjacent arrangement is formed. That is, the magnetic material sheet 110 on which each of the sintered magnetic material chips 112*a* is held by the lower protection layer 111 can be obtained.

Further, when each flexible sheet is adhered to both surfaces of the sintered magnetic material substrate 310 to provide a three-layer aggregate (at least one of the flexible sheets is the lower protection layer 111), the sintered magnetic material substrate 310 is divided into the sintered magnetic material chips 112*a* to form an aggregate thereof, and thereafter, one of the flexible sheets is peeled off to obtain the magnetic material sheet 110. Therefore, in the case of making the flexible sheets adhere to both surfaces, the above-described peeling off operation becomes easy by setting a lower adhesive force for one of the flexible sheets than the other (the lower protection layer 111), which is preferable.

According to the method of manufacturing the magnetic material sheet, the position of the sintered magnetic material chips does not change in both a horizontal direction and a thickness direction even after many sintered magnetic material chips become an aggregate. Therefore, a front surface and a back surface of the aggregate are flush by keeping the same flat surface without a deviation in height of the sintered magnetic material chips. Further, because the sintered magnetic material chips are arranged in a closely adhered layout substantially without gaps between, there is an effect of preventing leakage of magnetism to the extent that it does not damage the communication characteristic. Therefore, an aggregate of the sintered magnetic material chips can secure magnetic permeability substantially equivalent to that of the sintered magnetic material substrate before being divided into the sintered magnetic material chips.

The shape of the sintered magnetic material chips that constitute the sintered magnetic material layer 112 can have any shape so long as the aggregate of the sintered magnetic material chips is flush by keeping the same flat surface as described above, and an arbitrary shape such as a quadrangle, a hexagon, and a triangle can be used.

By dividing the sintered magnetic material substrate into the aggregate of the sintered magnetic material chips in advance, a ceramic substrate that is easily split off is processed in a flexible state, and therefore, the antenna module can be arranged on a curved surface. However, depending on an embodiment, the dividing process may be omitted, and a magnetic material sheet (or an antenna module) including a sintered magnetic material layer with a plurality of dividing grooves may be manufactured. In this case, the sintered magnetic material layer can be divided into chips by bending the antenna module itself according to usage at the time of using the antenna module.

Next, a method of manufacturing the double-sided adhesive spacer 120 is explained. First, a double-sided adhesive sheet base material is prepared by making a peel-off sheet (not shown) made of an adhesive layer and a separator adhered to both surfaces of a planar synthetic-resin core material such as polyethylene terephthalate, and then is processed to have the same size as that of the aggregate of the sintered magnetic material chips. Next, as shown in FIGS. 1 and 4, the double-sided adhesive sheet base material is punched by a mold to form the notch 122 in approximately the same shape as the antenna conductor 130, providing a double-sided adhesive sheet precursor. Next, only the separator is peeled off from the double-sided adhesive sheet precursor to expose the adhesion layer to both surfaces of the synthetic-resin core material, and the double-sided adhesive spacer 120 having the adhering surfaces 123 is obtained. Those without synthetic-resin core material can be also used as the double-sided adhesive spacer 120. Further, those punched by half-cut with the separator left on one surface of the double-sided adhesive sheet can be also used. The separator in this case is a sheet that is adhered to the adhering surface of the double-sided adhesive sheet base material (the double-sided adhesive sheet precursor) and is peeled off at the time of being adhered to an object.

Next, a method of manufacturing the antenna conductor 130 is explained. As shown in FIG. 1, the antenna conducting wire 131 is formed in a spiral shape in a planar view, and the power feeding pad 132 is fitted to both ends thereof. In the case of the antenna conducting wire 131 using copper, aluminum, silver, or the like, the antenna conducting wire 131 is oxidized and the communication characteristic is degraded when the antenna conducting wire 131 is left as it is. Therefore, it is desirable that an antioxidant process such as a plating process is performed on the antenna conducting wire 131 according to the needs. In order to reduce contact resistance, the electrode pad 132 is partially plated by masking an antenna conducting wire pattern with nickel+metal plating, or the electrode pad 132 is formed by punching, using a mold, a metal sheet of phosphor bronze, stainless steel, or the like with nickel+metal plating, and making the punched metal sheet adhere to the antenna conducting wire 131 by soldering or with a conductive adhesive agent. The antenna conducting wire 131 and the electrode pad 132 may be on the same flat surface. Alternatively, the electrode pad 132 may be on an upper surface side or a lower surface side of the antenna conducting wire 131.

Lastly, as shown in FIG. 1, the magnetic material sheet 110, the double-sided adhesive spacer 120, the antenna conductor 130, and the protection layer 140 that are prepared as described above are superposed from a lower layer in order. As a result, as shown in FIG. 2, the antenna module 100 of a thin type excluding a wasteful thickness is completed. More specifically, the antenna module 100 is completed by combining the double-sided adhesive spacer 120 and the antenna conductor 130 to form an intermediate layer, and by then making the protection layer 140 and the magnetic material sheet 110 adhere to upper and lower adhering surfaces 123 of the intermediate layer.

Figure 9:
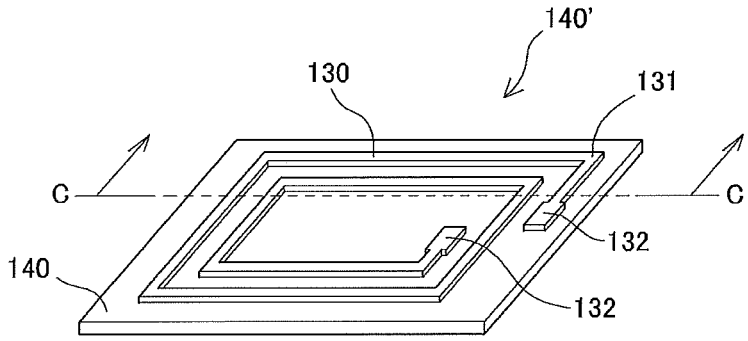
FIG. 9 is a perspective view of the protection layer with an antenna in the antenna module according to the embodiment of the present invention.

The method of manufacturing the antenna module according to the present invention is not limited to the above embodiment. Next, a further preferred manufacturing method to implement the present invention is explained. More specifically, a method of forming a protection layer 140' with an antenna as shown in FIG. 9 by integrally forming the antenna conductor 130 and the protection layer 140 in FIG. 1 before the assembling process is explained.

First, a copper foil having a thickness of 10 μm to 70 μm is prepared. A layer of a liquid protection material is coated in a thickness of about 5 μm to 25 μm on one of surfaces of the copper foil using a doctor blade method, a vapor deposition method or the like. In this way, a two-layer structure of the copper foil and the protection material is provided. Then, by a typical photolithographic method, the copper foil is exposed to a spiral antenna conductor pattern. By removing an unnecessary portion of the copper foil, the protection layer 140' with an antenna having a spiral pattern of the antenna conductor 130 is provided. As a method of forming a pattern of the antenna conductor, conventionally-known methods including a screen printing method, a liftoff method, etching, sputtering, and plating can be also used, other than the photolithographic method. Alternatively, a spiral antenna conducting wire may be simply adhered to a protection layer by an adhesive agent.

Figure 10:
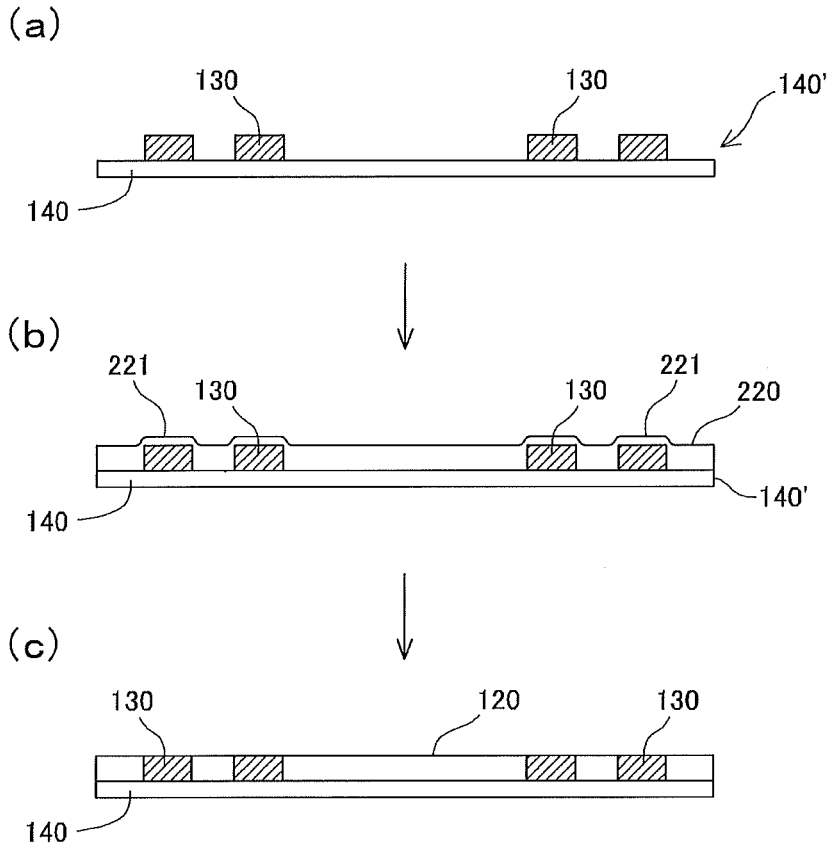
FIGS. 10(*a*) to (*c*) illustrate another process of producing an antenna structure in the antenna module in FIG. 2.

Then, a method of manufacturing the antenna module 100 using the protection layer 140' with an antenna manufactured in the above process is explained. FIG. 10(*a*) is a cross-sectional view taken along the line C-C of the protection layer 140' with an antenna. A planar adhesion body 220 is formed as a base material of the double-sided adhesive spacer 120, on a whole upper surface of the protection layer 140' with an antenna, that is, on a whole surface at a side where the antenna conducting wire is formed. For the planar adhesion body 220, an adhesion layer may be adhered to both front and back surfaces of the above-described planar synthetic-resin core, or an adhesion layer may be simply printed thereon, for example.

As shown in FIG. 10(*b*), after the planar adhesion body 220 is formed on the whole upper surface of the protection layer 140' with an antenna, a portion 221 of the planar adhesion body 220 is bulged on the antenna conductor 130. Next, the antenna conductor 130 is exposed by removing only the bulged portion 221 using a known method like etching. Thus, an antenna structure (an assembly of the double-sided adhesive spacer 120, the antenna conductor 130, and the protection layer 140) as shown in FIG. 10(*c*) is obtained. Finally, when the surface of the sintered magnetic material layer 112 of the magnetic material sheet 110 is superposed on the upper surface (the lower surface in FIG. 2) of the antenna structure, the antenna module 100 is obtained.

When this manufacturing method is employed, the antenna module can be efficiently assembled with high precision. First, in the magnetic material sheet 110, the sintered magnetic material layer 112 is fixed by the lower protection layer 111 to each other. Further, the protection layer 140 and the antenna conductor 130 are adhered by the doctor blade method, the vapor deposition, or the adhesive agent to be fixed to each other. Further, when the double-sided adhesive spacer 120 is superposed on the protection layer 140 and the antenna conductor 130, the superposed items are fixed to each other, and finally, the magnetic material sheet 110 is adhered to complete the antenna module. In other words, because components are fixed to each other throughout, the antenna module can be efficiently assembled with high precision, without the inconvenience of positional deviation, breakage, and deformation during assembly.

Figure 11:
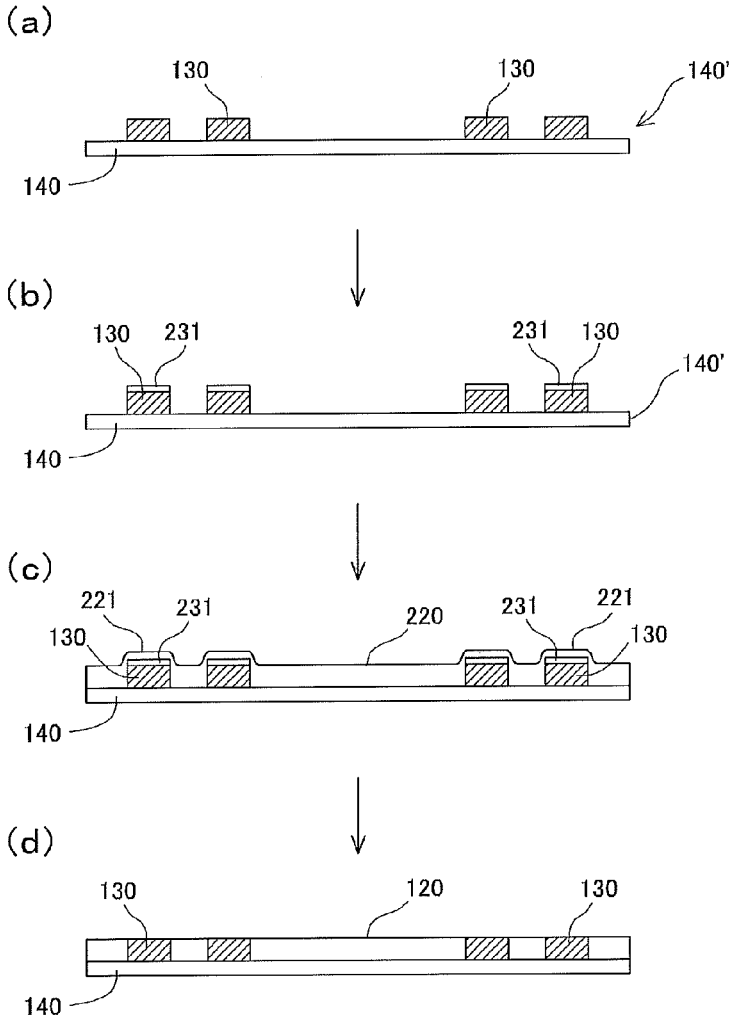
FIGS. 11(*a*) to (*d*) illustrate another process of producing an antenna structure in the antenna module in FIG. 2.

Another manufacturing method according to the present invention is explained below. First, the protection layer 140' with an antenna shown in FIG. 11(*a*) is prepared. Then, as shown in FIG. 11(*b*), an insulating film 231 in a planar shape having approximately the same shape as the antenna conductor 130 formed on the protection layer 140' with an antenna is prepared, and the insulating film 231 is formed on the antenna conductor 130. As a method of forming the insulating film 231, there is a method of further superposing the insulating film 231 on the above-described two-layer structure of the copper foil and the protection layer to provide a three-layer structure, and thereafter removing the copper foil and the insulating film 231 by the photolithographic method or the like, for example.

When the planar adhesion body 220 is further formed on the upper part of the protection layer 140' with an antenna that has the insulating film 231 formed on the antenna conductor 130, the portion 221 that has the planar adhesion body 220 bulged on the antenna conductor 130 is formed, as shown in FIG. 11(*c*). Next, when the insulating film 231 is peeled off, the bulged portion 221 formed on the insulating film 231 is also removed at the same time, and the antenna structure shown in FIG. 11(*d*) is obtained. Finally, when the magnetic material sheet 110 is superposed on the upper part of the antenna structure, the antenna module 100 is obtained. That is, when the manufacturing method like this is employed, the antenna module can be efficiently assembled with high precision like in the above-described manufacturing method.

Figure 12:
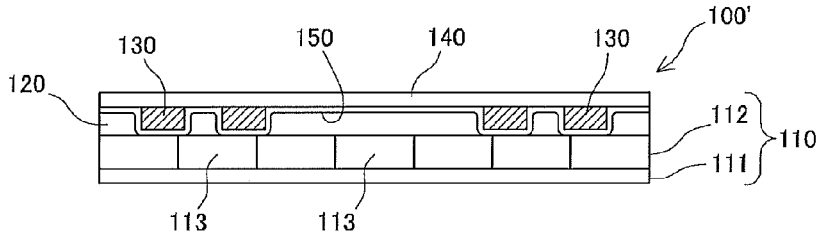
FIG. 12 is a cross-sectional view of an antenna module including a protection film according to another embodiment of the present invention.

While the structure and the method of manufacturing the antenna module 100 according to the embodiment of the present invention are explained above, a protection film 150 can be also added to selectively cover the surface of the antenna module 130. FIG. 12 is a cross-sectional view of an antenna module 100' including the protection film 150. As shown in FIG. 12, the protection film 150 covers the antenna conductor 130 and the protection layer 140. The protection film 150 is present between the double-sided adhesive spacer 120 and the antenna conductor 130, and is also present between the double-sided adhesive spacer 120 and the protection layer 140. That is, by making the protection layer 140 and the protection film 150 closely contact the surfaces of the antenna conductor 130, the antenna conductor 130 is prevented from being exposed to the atmosphere.

Figure 13:
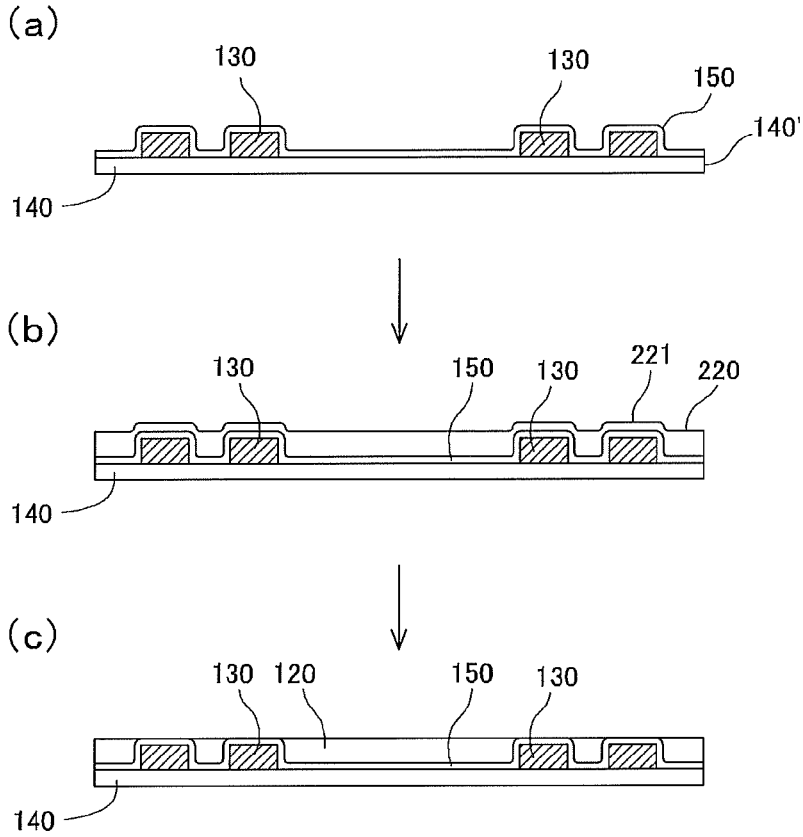
FIGS. 13(*a*) to (*c*) illustrate another process of producing an antenna structure in the antenna module in FIG. 12.

Next, a process of producing an antenna structure as an assembly of the double-sided adhesive spacer 120, the antenna conductor 130, the protection layer 140, and the protection film 150 is explained with reference to FIG. 13. The protection film 150 is obtained by coating a liquid resin of polyimide, polyamide imide, epoxy series, acrylic series, or urethane series on a whole surface of the protection layer 140' with an antenna shown in FIG. 9 at a side where the antenna conductor 130 is formed or at least on the antenna conductor 130 by a known method such as screen printing, and thereafter, by thermosetting a coated product at a high temperature. A thickness of the protection film 150 is preferably equal to or less than 10 μm, and more preferably, equal to or less than 5 μm. In the thus obtained protection layer 140' with an antenna, the antenna conductor 130 is closely entirely covered by the lower protection layer 111 and the protection film 150, as shown in FIG. 13(*a*). Then, the antenna structure including the protection film 150 can be produced through a process in FIGS. 13(*b*), (*c*) similar to that in FIG. 10(*b*).

That is, according to the antenna module 100', when adhesion is performed with only the double-sided adhesive spacer 120, the antenna conductor 130 and the double-sided adhesive spacer 120 sometimes do not made close enough contact to each other due to a gap between the antenna conductor 130 and the double-sided adhesive spacer 120. Therefore, when the antenna module 100 is used for a long period, there is a risk of degradation of the antenna characteristic due to oxidation of the antenna conductor 130. In a mobile phone application, due to the short life cycle of about five years or less, the antenna module according to the present invention can be manufactured without the protection film 150, as long as the above-described antioxidant process is performed. However, it is desirable to include the protection layer 150 when long-term, environmentally-resistant performance is required under a high-temperature and humid environmental condition, for example in a business reader/writer such as a point-of-sale register and an RFID device placed in an outdoor environment.

Figure 14:
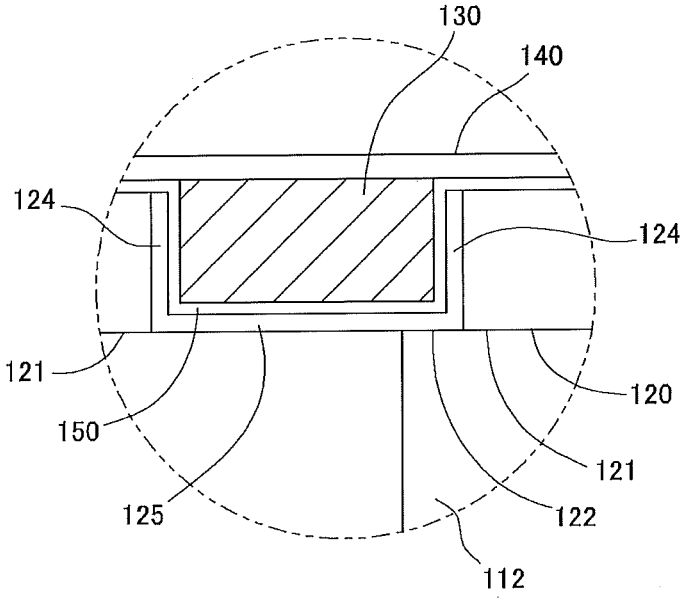
FIG. 14 is a cross-sectional view of the antenna module in FIG. 12, where an antenna conducting wire thickness a is less than a double-sided adhesive spacer thickness b.

Particularly, as shown in FIG. 14, when the gap 124 between the antenna conductor 130 and the double-sided adhesive spacer 120 and a gap 125 between the antenna conductor 130 and the sintered magnetic material layer 111 are present, the protection layer 150 can efficiently suppress degradation of the antenna conductor 130.

Figure 15:
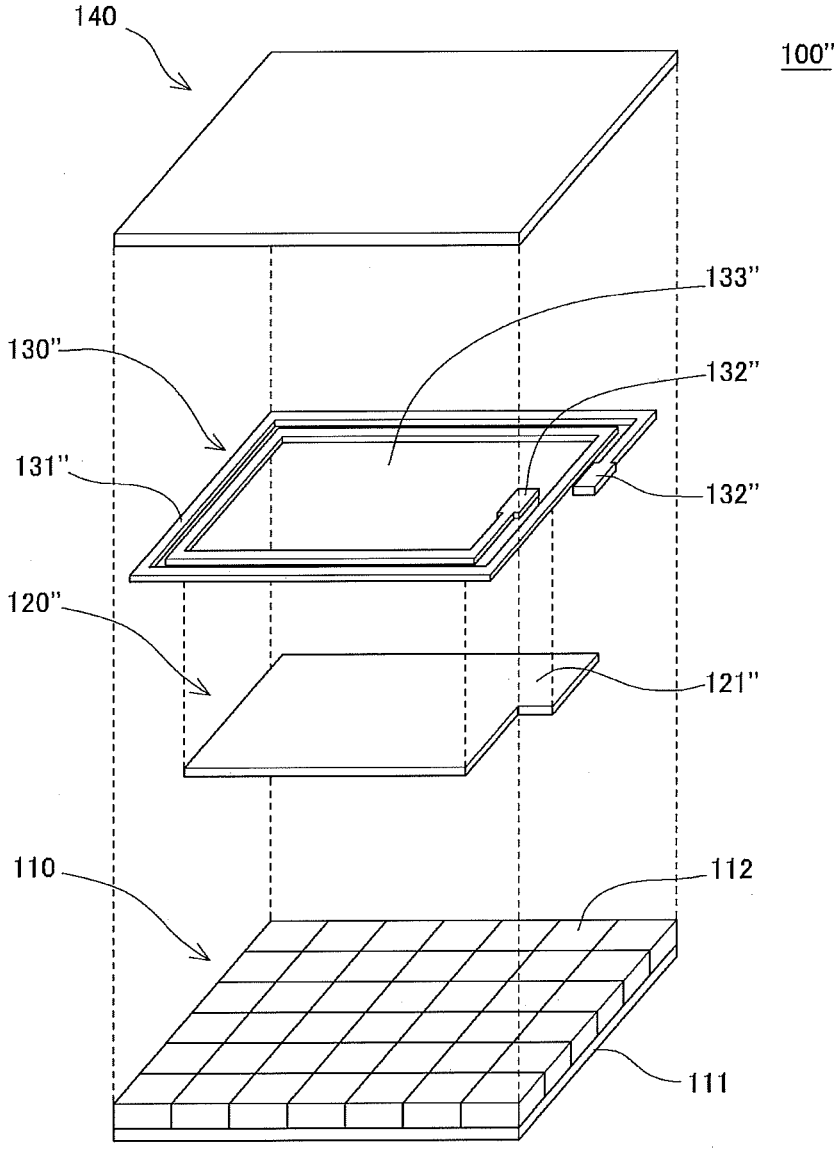
FIG. 15 is an exploded perspective view of the antenna module according to another embodiment of the present invention.

According to the embodiment of the present invention described above, substantially a whole part of a planar view shape of the fillet part 121 of the double-sided adhesive spacer 120 is in a so-called "complementary relationship" with a projection surface of the antenna conductor 130. However, when a gap between wire parts running in parallel with the antenna wire is narrow, for example, the double-sided adhesive spacer may be embedded in only the inward region surrounded by the innermost peripheral part of the antenna wire. That is, the planar view shape of the double-sided adhesive spacer (the fillet part) may occupy only a part of the planar shape that is in the "complementary relationship" with the projection surface of the antenna conductor. As shown in FIG. 15, a planar view shape of a fillet part 121" of a double-sided adhesive spacer 120" may be a shape that can be embedded in an inward region 133" (without a conducting wire) surrounded at least by an innermost peripheral part of an antenna conductor 130" having a spiral shape. Then, an intermediate layer is formed (arranged between the magnetic material sheet 110 and the protection layer 140) made of approximately a flat surface that does not substantially have a protrusion on an upper surface and a lower surface, by combining the double-sided adhesive spacer 120" and the antenna conductor 130".

At this time, the antenna conductor 130" is not adhered to either the sintered magnetic material layer 112 or the protection layer 140. Therefore, the sintered magnetic material layer 112 and the protection layer 140 may be adhered to the antenna conductor 130" with an adhesive agent (not shown) provided in advance to upper and lower surfaces of the antenna conductor 130". A surplus thickness is generated by using the adhesive agent. However, by pressing an assembled antenna module in a thickness direction, the adhesive agent is pushed out, and moves to a gap between wire parts of the antenna conducting wire. Therefore, the thickness of the adhesive agent can be significantly reduced.

The present invention has wide application in the fields of non-contact communication devices and smartphones.

The present invention is explained above in detail with reference exemplary embodiments. However, it should be understood that what is explained above are specific embodiments of the present invention, and the embodiments can be implemented by changing a part of the embodiment based on a technical concept of the present invention so long as the effect of the present invention is not adversely affected.

What is claimed:

1. An antenna module comprising:

a magnetic material sheet for focusing a magnetic flux;

an antenna conductor deposited on the magnetic material sheet and formed in a predetermined pattern; and a protection layer deposited on the antenna conductor and for protecting the antenna conductor and a double-sided adhesive spacer arranged between the magnetic material sheet and the protection layer to form an intermediate layer together with the antenna conductor;

wherein a shape of the double-sided adhesive spacer includes at least a part of a planar shape that is complementary to a projection surface of the antenna conductor, said double-sided adhesive spacer adhering the magnetic material sheet and the protection layer without interposing any adhesive layer between the magnetic material sheet and the antenna conductor.

2. The antenna module according to claim 1, wherein a notch having the planar shape in which the antenna conductor is inserted is formed in the double-sided adhesive spacer, and the antenna conductor is arranged in the notch.

3. The antenna module according to claim 2, wherein a shape of the antenna conductor and a shape of the notch are substantially the same, and the antenna conductor is embedded in the notch.

4. The antenna module according to claim 2, wherein the magnetic material sheet includes a lower protection layer, and a sintered magnetic material layer adhered to an upper surface of the lower protection layer.

5. The antenna module according to claim 1, wherein at least a part of the double-sided adhesive spacer is arranged in an inward region surrounded by an innermost peripheral surface of the antenna conductor.

6. The antenna module according to claim 1, wherein a thickness of each of the antenna conductor and the double-sided adhesive spacer are approximately the same, and the antenna conductor and the double-sided adhesive spacer constitute a flat surface without unevenness.

7. The antenna module according to claim 1, wherein a gap of 10 μm to 800 μm is provided between the antenna conductor and the double-sided adhesive spacer.

8. The antenna module according to claim 1, further comprising a protection film arranged between the antenna conductor and the double-sided adhesive spacer and for covering the antenna conductor.

9. The antenna module according to claim 1, wherein the magnetic material sheet includes a lower protection layer, and a sintered magnetic material layer adhered to an upper surface of the lower protection layer.

10. The antenna module according to claim 9, wherein the sintered magnetic material layer is an aggregate of a plurality of sintered magnetic material chips arranged substantially without a gap, and the aggregate of the sintered magnetic material chips forms a flat surface without unevenness.

11. The antenna module according to claim 9, wherein the lower protection layer is an insulator, a metal shield, or a laminated body of the insulator and the metal shield.

12. The antenna module according to claim 1, wherein the lower protection layer is an insulator, a metal shield, or a laminated body of the insulator and the metal shield.

13. The antenna module according to claim 1, wherein an adhesive layer is formed on a top surface or a bottom surface of the antenna module.

14. The antenna module according to claim 1, wherein a total thickness of the antenna module is 30 μm to 515 μm.

15. A method of manufacturing an antenna module comprising steps of:

providing a magnetic material sheet for focusing a magnetic flux; depositing an antenna conductor on the magnetic material sheet;

arranging a double-sided adhesive spacer on the magnetic material sheet to form an intermediate layer with the double-sided adhesive spacer and the antenna conductor; and depositing a protection layer for protecting the antenna conductor on the magnetic material sheet via the antenna conductor and the double-sided adhesive spacer, wherein a shape of the double-sided adhesive spacer includes at least a part of a planar shape that is complementary to a projection surface of the antenna conductor, said double-sided adhesive spacer adhering the magnetic material sheet and the protection layer without interposing any adhesive layer between the magnetic material sheet and the antenna conductor.

16. The method of manufacturing an antenna module according to claims 15, wherein a notch having a shape in which the antenna conductor is inserted is formed in the double-sided adhesive spacer, and the antenna conductor is arranged in the notch.

17. The method of manufacturing an antenna module according to claim 15, wherein the antenna conductor and the protection layer are integrally formed, and the antenna conductor is arranged on the magnetic material sheet together with the protection layer.

18. The method of manufacturing an antenna module according to claim 15, wherein the step of providing the magnetic material sheet includes steps of providing a magnetic material green sheet of a predetermined size, forming a sintered magnetic material substrate by sintering the magnetic material green sheet, making a flexible sheet adhered to at least one surface of the sintered magnetic material substrate, and dividing the sintered magnetic material substrate into a plurality of chips by bending the sintered magnetic material substrate to which the flexible sheet is adhered.

19. The method of manufacturing an antenna module according to claim 18, further comprising a step of forming a plurality of dividing grooves on the magnetic material green sheet before sintering the magnetic material green sheet, wherein the sintered magnetic material substrate is divided into a plurality of chips by bending the sintered magnetic material substrate to which the flexible sheet is adhered, along the plurality of dividing grooves.

20. The method of manufacturing an antenna module according to claim 18, wherein the flexible sheet is a lower protection layer.

21. A double-sided adhesive spacer for making a magnetic material sheet and a protection layer of an antenna module adhered to both surfaces of the double-sided adhesive spacer, and for forming an intermediate layer between the magnetic material sheet and the protection layer, together with an antenna conductor, wherein a shape of the double-sided adhesive spacer includes at least a part of a planar shape that is complementary to a projection surface of the antenna conductor, and said double-sided adhesive spacer adhering the magnetic material sheet and the protection layer without interposing any adhesive layer between the magnetic material sheet and the antenna conductor.

22. The double-sided adhesive spacer according to claim 21, wherein the double-sided adhesive spacer is made of a synthetic resin.

* * * * *